US005353954A

United States Patent [19]

Steward et al.

[11] Patent Number: 5,353,954

[45] Date of Patent: Oct. 11, 1994

[54] LARGE RADIUS FOOTED CONTAINER

[75] Inventors: Sterling L. Steward, Douglasville; Paul R. Kaufman, Atlanta, both of Ga.; David A. Brunson, Lee's Summit, Mo.

[73] Assignee: Constar Plastics, Inc., Atlanta, Ga.

[21] Appl. No.: 77,856

[22] Filed: Jun. 16, 1993

[51] Int. Cl.[5] ..... B65D 1/02

[52] U.S. Cl. ..... 220/608; 215/1 C

[58] Field of Search ..... 215/1 C; 220/606, 608, 220/609, 604

[56] References Cited

U.S. PATENT DOCUMENTS

| | | | |
|---|---|---|---|
| 4,249,666 | 2/1981 | Hubert et al. | 220/608 |
| 4,318,489 | 3/1982 | Snyder et al. | 220/606 |
| 4,865,206 | 9/1989 | Behm et al. | 220/606 |
| 5,024,340 | 6/1991 | Alberghini et al. | 220/608 |
| 5,133,468 | 7/1992 | Brunson et al. | 220/606 |
| 5,205,434 | 4/1993 | Brunson et al. | 220/608 |

*Primary Examiner*—S. Castellano

*Attorney, Agent, or Firm*—Locke Reynolds

[57] ABSTRACT

A plastic container is configured for high pressure containment of fluid. The plastic container includes a tubular body portion generally symmetric about a vertical axis, and a base portion unitary with the body portion and having a plurality of feet for supporting the container upright on a horizontal surface. In cross-section, the base of the container is defined by a first line comprising a series of curves of serially diminishing radius from the body portion through the axis to each of the feet. The series of curves having centers of curvature alternating between positions inside the container and positions outside the container.

19 Claims, 4 Drawing Sheets

LARGE RADIUS FOOTED CONTAINER

BACKGROUND OF THE INVENTION

This invention generally relates to plastic bottles suitable for retention of fluids under pressure, including carbonated beverages or the like. In particular, the present invention relates to a footed plastic bottle having an integral base that provides a stable support for the plastic bottle on level surfaces.

Carbonated beverages such as soft drinks are commonly packaged in lightweight, flexible, plastic containers. Because of their reduced rigidity as compared to glass containers, early efforts to manufacture plastic containers typically involved construction of hemispherical bases. A hemispherical base design can withstand high internal pressure and shock induced external pressures by evenly distributing the pressure induced stresses. A hemispherical base design maximizes the volume contained by a given amount of plastic material, and allows relatively thin plastic containers to withstand internal pressures as high as 100 p.s.i. without failure.

However, hemispherical base containers are not without problems. Hemispherical base containers require a separate base cup to support the plastic container in an upright position. Manufacture and attachment of this separate base cup is not always cost-effective, in part because of increased manufacturing costs and because it requires incorporation of failure prone base cup attachment production steps.

To avoid these problems, plastic container manufacturers have produced a variety of one piece plastic containers having a non-hemispherical bases modified to support the container. For example, "champagne" type bases having a complete annular ring capable of resting upon a level surface have been disclosed in U.S. Pat. Nos. 3,722,726; 4,108,324; 4,247,012; and 4,249,666. Although such one-piece champagne type plastic bottles are stable without a base cup, they still require significant increase in plastic resin to form the base, and even with the increased plastic resin are still prone to drop impact failure as compared to hemispherical bottles.

An alternative to both hemispherical and champagne type bases has been developed. Commonly known as a "looted" container, this type of base is disclosed, for example, in U.S. Pat. Nos. 3,598,270; 4,294,366; 4,368,825; 4,865,206; and 4,867,323. Footed containers typically have multiple feet that bulge or protrude outward from an otherwise generally hemispherical base. Manufacture of such footed containers can be difficult, since uneven distribution of the plastic resin in the base can cause uneven projection of the feet when the container is filled with a carbonated liquid, resulting in a "rocker bottom" that allows the container to wobble. Further, provision of the feet can unduly increase stress concentration in the feet, again resulting in increased drop impact failure. Additionally, when such a container is filled with a carbonated liquid, the axial portion of the container bottom can creep or grow downwardly to contact the supporting surface or even protrude below the level of the bottom of the feet again resulting in a "rocker bottom" that allows the container to wobble.

SUMMARY OF THE INVENTION

The present invention provides a stress resistant looted container suitable for holding high pressure liquids such as carbonated beverages. The plastic container of the present invention includes a tubular body portion generally symmetric about a vertical axis, and a base portion unitary with the body portion. The base portion has a plurality of feet for supporting the container upright on a horizontal surface. The base portion is defined in cross-section by a first line comprising a series of curves of serially diminishing radius from the body portion through the axis to a lowest point on each of the feet. The series of curves have centers of curvature alternating between positions inside the container and positions outside the container. Generally, a first end of the largest radius curve of the series is tangent to the tubular body portion of the container. The first line is completed by a line segment joining the smallest radius curve of the series to the tubular body portion at a point opposite the first end of the largest radius curve of the series.

In preferred embodiments, the radius of curvature of the largest of the series of curves along the first line defining the base of the plastic container is less than or equal to the radius of the tubular body portion. In absolute dimensions, the minimum radius of curvature of any of the series of curves along the first line is greater than one centimeter. In relative dimensions, the minimum radius of curvature of any of the series of curves along this first line is greater than one-fifth of the radius of the tubular body portion.

In one preferred embodiment, the first line of the base of the plastic container consists essentially of five curves, with the centers of curvature of the first and second of the series of curves being located on a first side of the axis of the plastic container and the centers of curvature of the remaining curves being located on a second side of the axis. In another preferred embodiment, wherein the first line of the base of the plastic container consists essentially of five curves, the centers of curvature of the first and second of the series of curves are located on the axis of the plastic container and the centers of curvature of the remaining curves being located off to one second side of the axis. Optionally, the centers of curvature of a third and a fourth of the curves can be situated at the same radial distance from the axis.

Generally, the feet of the plastic container are further defined by a second line intersecting the first line at the lowest point of the first line, with each second line comprising an arc segment lying in a common plane at a constant radius from said axis on each side of and contiguous to the first line. The second lines of the plurality of feet forming the container form a discontinuous standing ring upon which the container rests. Each adjacent pair of second lines defining the plurality of feet can be joined together end to end by a vertically curving segment which can optionally include a linear segment at a highest point between the feet.

Where no linear segment is present at the highest point between the feet, the vertical displacement h, measured from the plane of the second lines, of the vertically curving segment is defined generally by $$h=k(1-\cos((2\pi-N\alpha))),$$

where k is a proportionality constant, N is the number of feet, $\alpha$ is the angular length of said second line, and $\beta$ the angular displacement from an end of said second line on one foot toward an adjacent foot.

Each of the feet of a plastic container can be further defined by a series of arc segments parallel to the second line, the series of arc segments diminishing in length from the second line toward the axis of the plastic container. The length s of the series of arc segments is defined generally by $$s-a(r-r_o)/(R-r_o), r_o \leqq r \leqq r_2,$$

where $r_2$ is the radius from the axis of the second line defining the standing ring and $r_o$ is the radius from the axis of the innermost arc segment.

In a most preferred embodiment, the plastic container includes a tubular body portion generally symmetric about a vertical axis, and a base portion unitary with the body portion having a plurality of feet for supporting the container upright on a horizontal surface. The base portion is defined in cross-section by a first line a first end of which is tangent to the tubular body portion of the container, the first line consisting essentially of a continuous series of five curves of serially diminishing radius from the first end through the axis to a lowermost point on each of the feet, with the series of curves having centers of curvature alternating between positions inside the container and positions outside the container. Each of the feet are further defined by a second line intersecting the first line at a lowest point of the first line, with each second line comprising an arc segment lying in a common plane at a constant radius from the axis on each side of and contiguous to the first line. The second line defines the standing ring of the container and each of the feet are joined together end to end by a vertically curving segment. Each of the feet are further defined by a series of arc segments parallel to the second line, the series of arc segments diminishing in length from said second line toward said axis to a point directly between the centers of curvature of a third and a fourth of the curves on the first line.

Advantageously, the design of the base of a plastic container in accordance with the present invention allows improved stability under high pressure conditions as compared to other types of footed bottle designs. Plastic containers constructed to have the previously described unique footed base will not have "rocker bottom" when unpressurized or when filled with typical pressurized liquid.

These and other features and advantages of the present invention will become apparent to those skilled in the art upon consideration of the following detailed description of preferred embodiments exemplifying the best mode for carrying out the invention as presently pervceived. The detailed description particularly refers to the accompanying drawings.

DETAILED DESCRIPTION OF THE INVENTION

Figure 1:
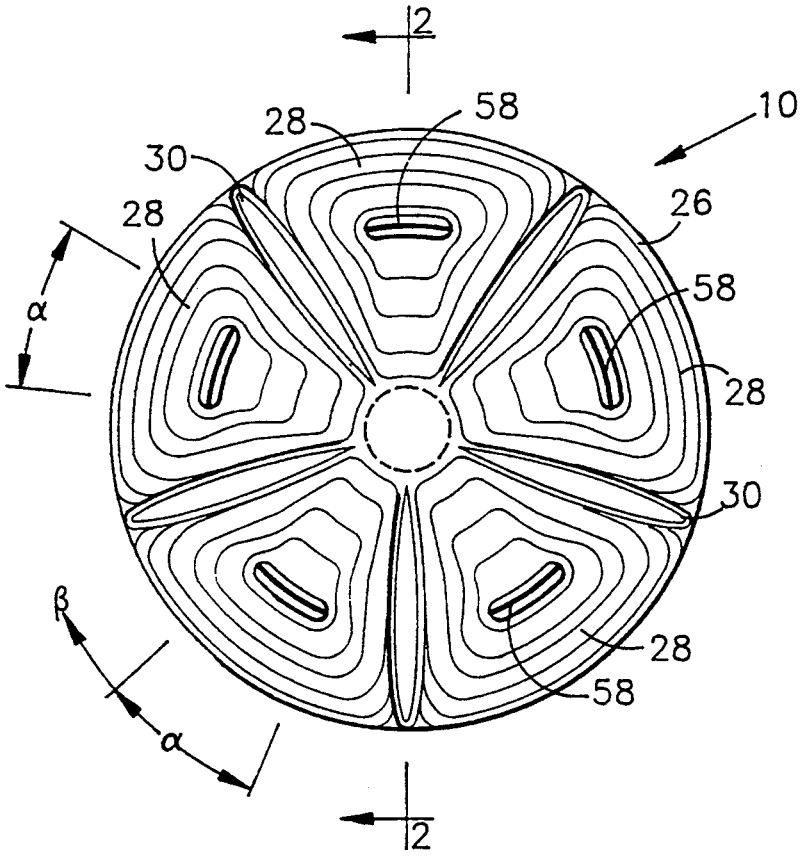
FIG. 1 is a schematic contour drawing of the bottom of a bottle in accordance with the present invention with a base having five downward projections forming feet suitable for supporting the bottle.
Figure 2:
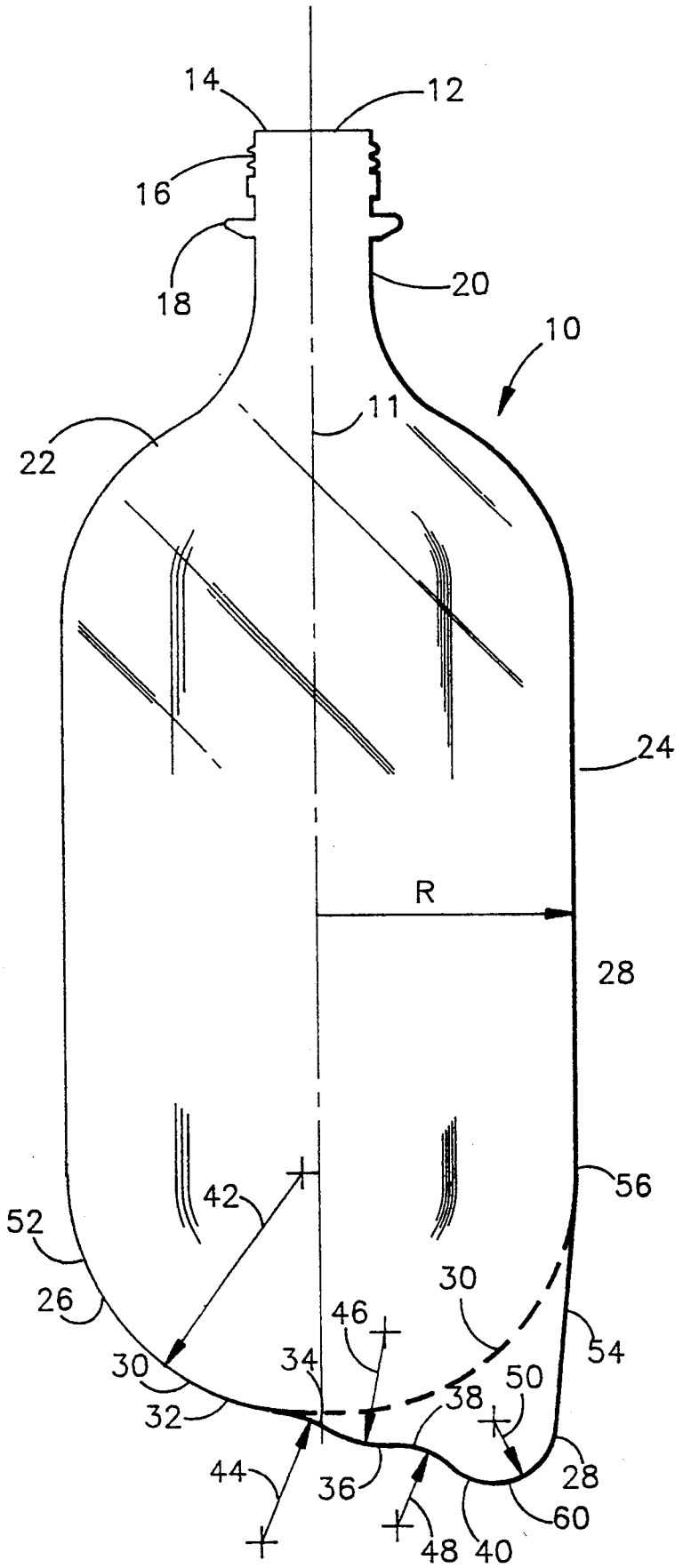
FIG. 2 is a diagrammatic cross sectional view of the bottle of FIG. 1 taken along line 2—2.
Figure 3:
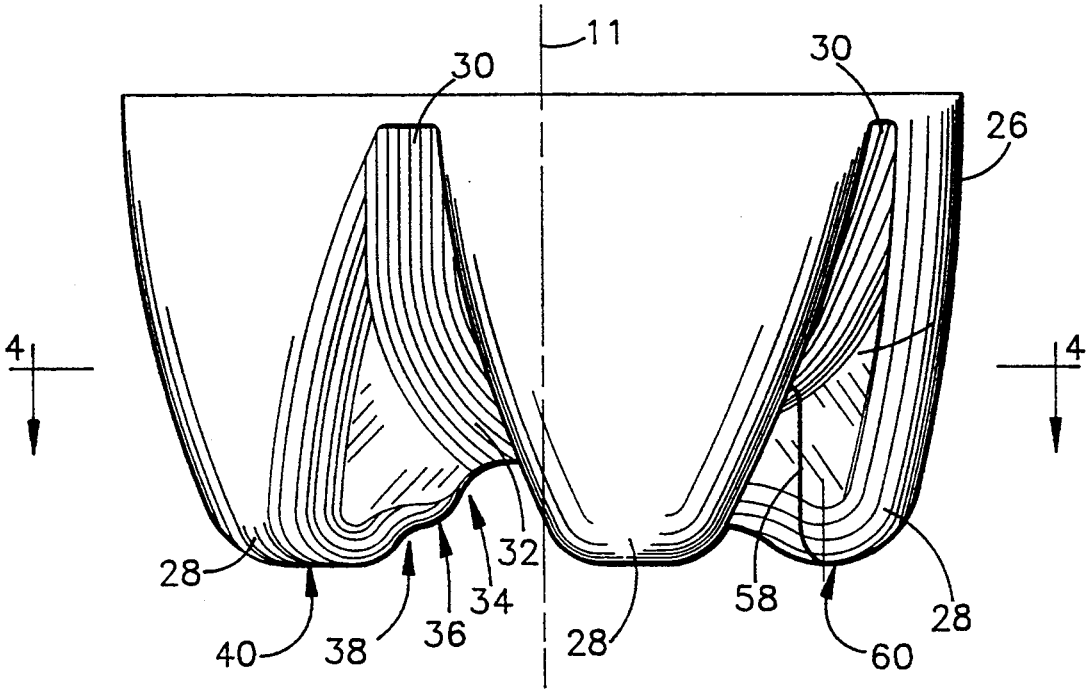
FIG. 3 is a schematic contour drawing showing a side view of the base portion of the bottle of FIG. 1.

A blow molded thermoplastic resin bottle 10 in accordance with the present invention is shown in FIGS. 1–3 to be generally symmetric about a longitudinal axis 11. As best seen schematically illustrated in FIG. 2, the bottle 10 includes a mouth 12 defined by a rim 14 positioned superior to a finish 16. The finish 16 is located above an integrally defined support ring 18. The remainder of the bottle includes a neck 20, a shoulder portion 22, a substantially tubular or cylindrical body portion 24, and a base 26 that supports the bottle 10. The radius R of cylindrical body portion 24 is conventionally defined as the perpendicular distance between the wall of the cylindrical body portion and the longitudinal axis 11.

Preferably, the bottle 10 is constructed by stretch blow molding of polyethylene terephthalate parisons in the conventional manner to achieve biaxially oriented walls that readily withstand typical pressures of carbonated beverages. The parisons generally have less than about 25 grams of polymer for each liter of volume of the final container, a value that minimizes material usage while still providing sufficient strength to contain liquids pressurized by carbonation.

The base 26 is configured from an ordered arrangement of integral downward projections 28 that form five radially symmetrically ordered "feet" to support the bottle. The projections 28 are separated by generally hemispherical segments 30 that arc between the projections 28 to connect the cylindrical body portion 24 and the center of the base 26. While the Figures show containers having five feet, which might be employed for volumes of between 1.5 and 3.5 liters, other numbers of feet are permissible. Because of space and blow molding limitations, a larger number of feet (e.g. seven or nine feet) might only used in bottles having a capacity greater than three liters. For bottles having capacity of less than 1 liter, only three feet might be employed.

As best seen in schematic cross section in FIG. 2, the base 26 is uniquely constructed from a series of arcs 32, 34, 36, 38 and 40 respectively defined by radii 42, 44, 46, 48 and 50. The arcs 32 through 40 form a continuous curved line, differentiable at all points, that extends from a first point 52 at the connection between the cylindrical body portion 24 and the base 26 toward the opposite side of the base. As shown in FIG. 1, the series of arcs extends through the center of each hemispherical segment 30, through the axis 11, and continues through an oppositely situated downward projection 28. The first line formed by the series of arcs 32–40 is completed by a line segment 54 joining the smallest radius curve of the series 40 to the tubular body portion 24 at a point 56 opposite the first end 52 of the largest radius curve of the series. The line segment 54 joining the smallest radius curve 40 of the series to the tubular body portion 24 can be defined by a curve having a radius greater than the diameter of the tubular body portion.

The arcs 32, 34, 36, 38 and 40 respectively have a serially diminishing radius from the first end 52 at the junction with the body portion 24 through the axis 11 to each of the feet 28. That is, radius 42 is the largest and each of the radii 44, 46, 48 and 50 are progressively smaller. In addition, the series of five arcs 32–40 have centers of curvature (shown respectively by radii 42–50) alternating between positions on each side of the series of arcs defining the first line. In the preferred embodiment illustrated, the centers of curvature of the radii alternate between positions inside the bottle 10 and positions outside the bottle 10.

In the embodiment illustrated in FIG. 1, the centers of curvature of arcs 32 and 34 are located on a common side of the longitudinal axis 11, with the centers of curvature of the remaining arcs 36, 38 and 40 being located on the opposite side of the longitudinal axis 11. The centers of curvature of arcs 32 and 34 can be located on the axis 11 and might be positioned on the same side of the longitudinal axis 11 as the centers of curvature of arcs 36, 38 and 40. Optionally, the centers of curvature of arcs 36 and 38 can be situated at the same radial distance from the axis. The maximum radius of curvature of any of the series of arcs is about equal to the radius R of the cylindrical body portion 24. Further, the minimum radius of curvature of any of the series of arcs is generally greater than or equal to one-fifth of the radius R of the cylindrical body portion. The use of too small a radius of curvature for any of the series of arcs tends to give rise to stress which can cause contribute to failure of the bottle.

Each of the downward projections 28 that collectively define the "feet" of the bottle 10 are further defined by a second line 58 perpendicularly intersecting the series of arcs at a lowest point 60 on arc 40. The second line 58 is best shown in FIG. 1 and is defined by arc segments of length $\alpha$ lying in a common plane at a constant radius from the longitudinal axis 11 on each side of and contiguous to the series of arcs 32–40 defining each of the feet 28. This line 58 defines the standing ring of the container, and includes those points that actually contact a horizontal surface when the bottle 10 is positioned in a normal upright stance.

Figure 7:
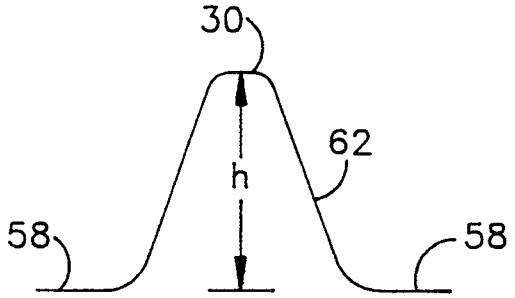
FIG. 7 is a diagrammatic plane projection of the curve joining adjacent standing ring portions of the base shown in FIGS. 1 and 3.
Figure 4:
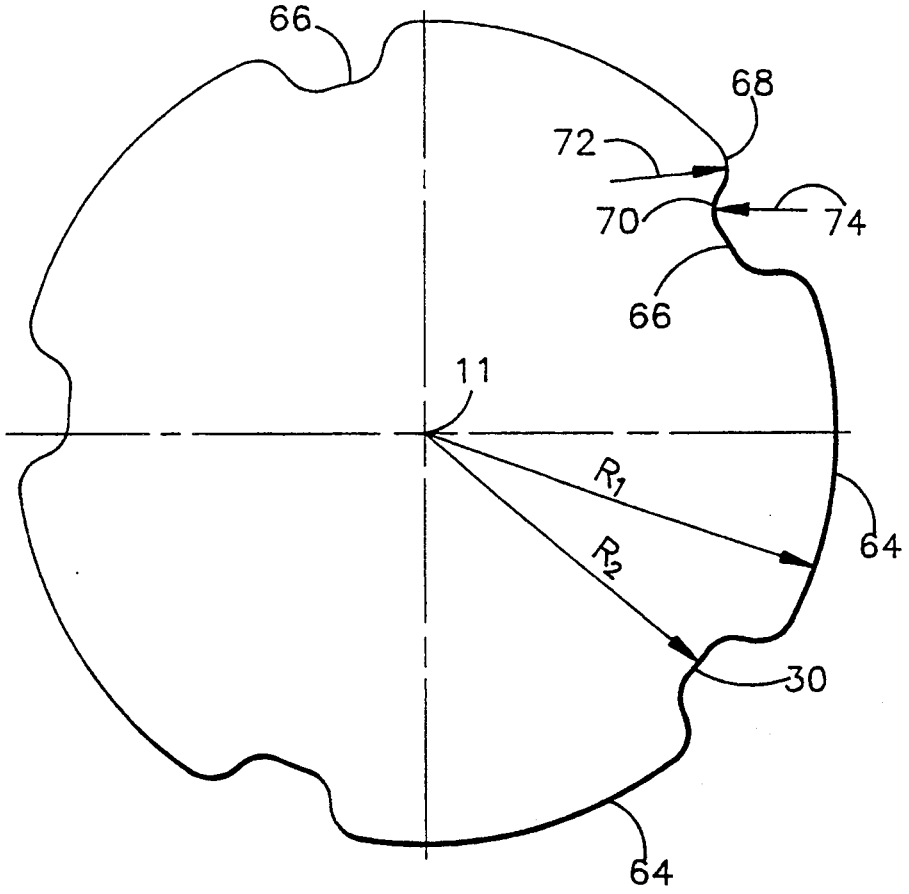
FIG. 4 is a diagrammatic cross sectional view of the base portion shown in FIG. 3 taken along line 4—4.

As best illustrated in FIG. 3, the second line 58 defining each of the feet is joined together end to end by a vertically curving line 62. The vertical displacement h of the vertically curving line 58 from the plane of the standing ring is illustrated in FIG. 7. The vertically curving line intersects hemispherical segments 30 that separate each two adjacent feet 28. A horizontal section of base 26 taken along line 4—4 of FIG. 3 is shown in FIG. 4 to comprise a set of arc segments 64 of radius $R_1$ measured from axis 11. A second set of smaller arc segments 66 having a smaller radius $R_2$ measured from axis 11 are situated between each adjacent pair of the set of arc segments 64 and intersect the hemispherical segments 30 that separate each two adjacent feet 28. The ends of arc segments 64 and 66 are joined to each other by a pair of curves 68 and 70 having much smaller radii of curvature 72 and 74 respectively.

Figure 8:
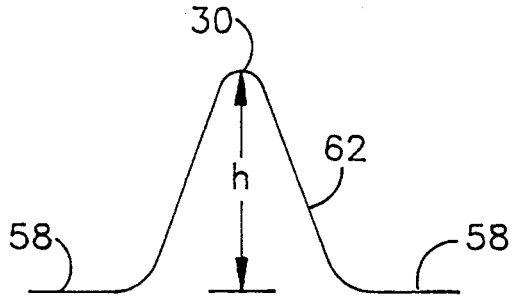
FIG. 8 is a diagrammatic plane projection similar to FIG. 7 showing the curve joining adjacent standing ring portions of the base shown in FIG. 5.
Figure 6:
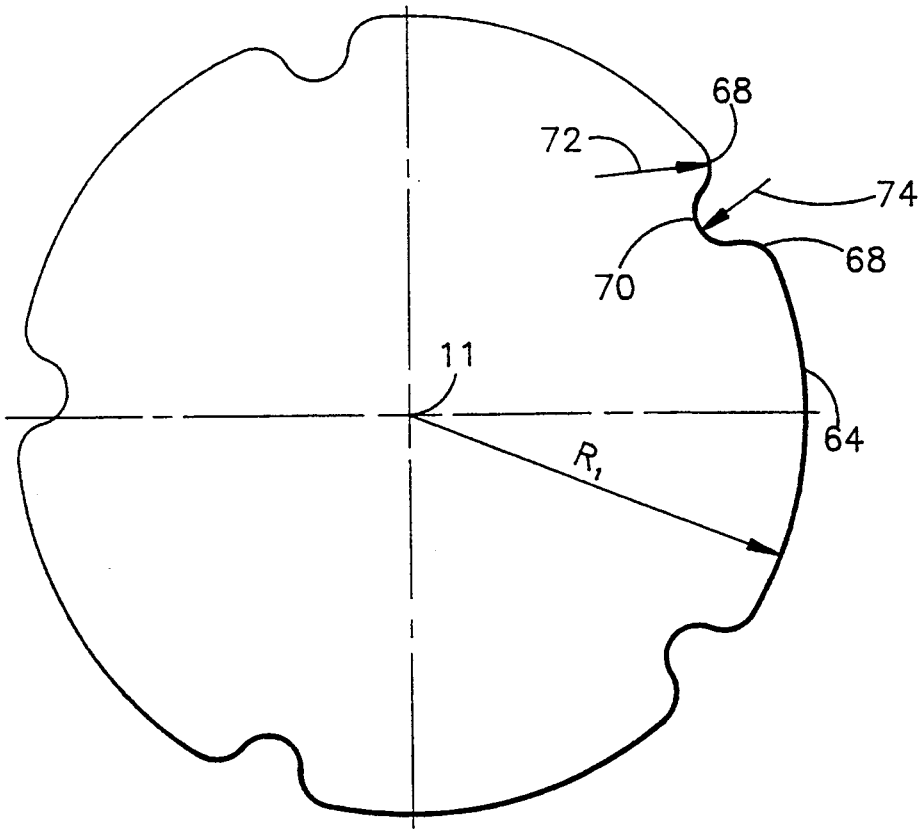
FIG. 6 is a diagrammatic cross sectional view of the base portion shown in FIG. 5 taken along line 6—6.
Figure 5:
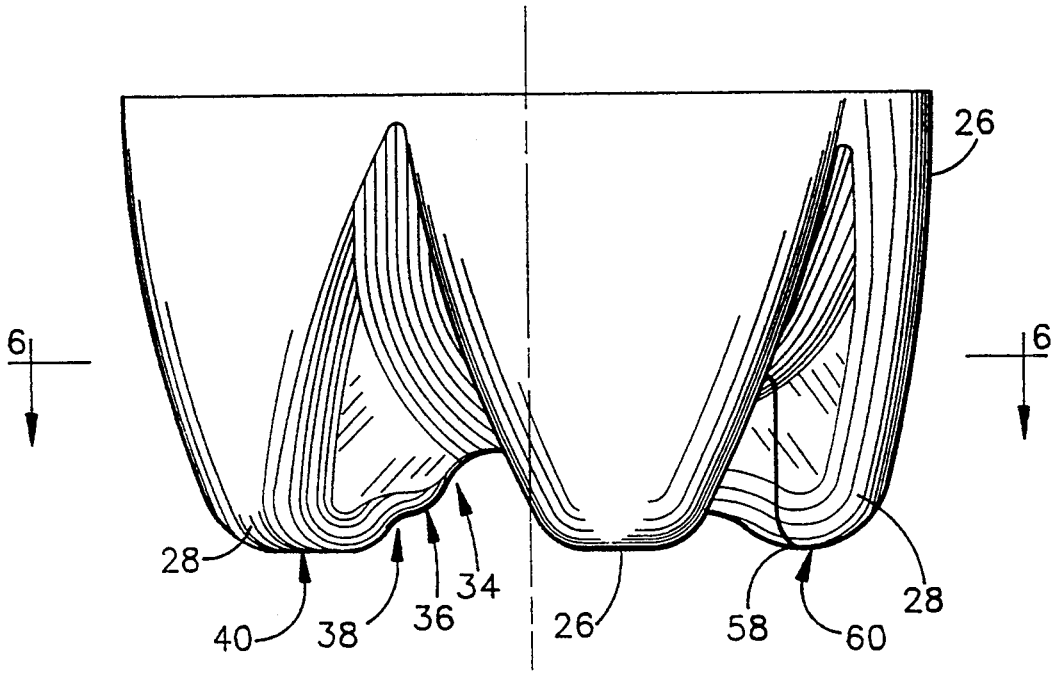
FIG. 5 is a schematic contour drawing showing a side view of the base portion of a variation on the bottle of FIG. 1.

FIGS. 5 and 6 illustrate a variation of the base 26 in which the radial extent $\alpha$ of each of the feet 28 is increased and the hemispherical segments 30 that separate each two adjacent feet 28 have a curved rather than essentially flat cross section. This has the effect of diminishing the radial extent of arc segments 66 to a point so that curve 70 is continuous between curves 68 connected to arc segments 64. The vertically curving line 58 shown in FIG. 8 which extends between each two adjacent feet 28 of the base shown in FIG. 5 is defined approximately by $$h=k(1-\cos(2\pi N\beta/(2\pi-N\alpha))),$$

where k is a proportionally constant, N is the number of feet, $\alpha$ is the angular length of said second line, and $\beta$ the angular displacement from an end of each second line 58 on one foot 28 toward an adjacent foot.

Each of the downward projections 28 that collectively define the feet of the bottle 10 are further defined by a series of arc segments 76 parallel to the second line 58 shown in FIG. 1, the series of arc segments 76 diminishing in length from line 58 toward the longitudinal axis 11 to a point 78 generally between the centers of curvature of arcs 36 and 38. The length s of said series of arc segments 76 parallel to the line 58 are defined generally by:

$$s=a(r-r_0)/(r_s-r_0),\ r_0\leqq r\leqq r_s,$$

where $r_s$ is the radius from the axis 11 to the second line 58 defining the standing ring and $r_o$ is the radius from the axis to the innermost arc segment, and a is the angular length of line 58.

Although the invention has been described in detail with reference to certain preferred embodiments, variations and modifications exist within the scope and spirit of the invention as defined in the following claims.

What is claimed is:

1. A plastic container comprising a tubular body portion generally symmetric about a vertical axis, and a base portion unitary with the body portion having a plurality of feet for supporting the container upright on a horizontal surface, with the feet in the base portion being defined in cross-section by a lower portion of respective first lines, each respective first line comprising a series of curves continuously connected and having serially diminishing radius from the body portion through the axis to a portion of the respective foot, with said foot portion touching the horizontal surface, the series of curves having centers of curvature alternating between positions inside the container and positions outside the container.

2. The plastic container of claim 1 wherein each said first line includes a first end on the largest radius curve of the series which is tangent to the tubular body portion of the container.

3. The plastic container of claim 2 wherein each said first line is connected by a line segment joining the smallest radius curve of the series to the tubular body portion at a point opposite said first end on the largest radius curve of the series.

4. The plastic container of claim 1 wherein the feet are further defined by respective second lines, said respective second lines intersecting the respective first liens at respective lowest points of the respective first lines, each respective second line comprising an arc segment lying in a common plane at a constant radius from said axis on each side of and contiguous to its respective first line.

5. The plastic container of claim 4 wherein the respective second lines defining each of the feet are joined together end to end by a vertically curving segment.

6. The plastic container of claim 5 wherein the vertical displacement h of the vertically curving segment from the plane of the second lines is defined generally by $$h=k(1-\cos(2\pi N\beta/(2\pi-N\alpha))),$$

where k is a proportionally constant, N is the number of feet, $\alpha$ is the angular length of said second line, and $\beta$ the angular displacement from an end of said second line.

7. The plastic container of claim 4 wherein each of the feet are further defined by a series of arc segments parallel to the second line, the series of arc segments diminishing in length from said second line toward said axis.

8. The plastic container of claim 7 wherein the length s of the series of arc segments is defined generally by $s=a(r-r_o)/(r_s-r_o)$, $r_o \leqq r \leqq r_s$, where $r_s$ is the radius from the axis to the second line defining the standing ring, a is the arc length of the second line, and $r_o$ is the radius from the axis of the innermost arc segment.

9. The plastic container of claim 1 wherein the maximum radius of curvature of any of the series of curves along the first line is less than the radius of the tubular body portion.

10. The plastic container of claim 1 wherein the minimum radius of curvature of any of the series of curves along the first line is greater than one centimeter.

11. The plastic container of claim 1 wherein the minimum radius of curvature of any of the series of curves along the first line is greater than one-fifth of the radius of the tubular body portion.

12. The plastic container of claim 1 wherein the first line consists essentially of five curves joined continuously end to end.

13. The plastic container of claim 12 wherein the centers of curvature of a first and a second of the series of curves are located on a first side of said axis, and the centers of curvature of the remaining curves are located on a second side of said axis.

14. A plastic container comprising a tubular body portion generally symmetric about a vertical axis, and a base portion unitary with the body portion having a plurality of feet for supporting the container upright on a horizontal surface, the feet in the base portion being defined in cross-section by a lower portion of respective first lines, each respective first line consisting essentially of a continuous series of five curves of serially diminishing radius, each respective first line extending from a first point on the body portion through the axis to a portion of the respective foot, with said foot portion touching the horizontal surface, the series of curves having centers of curvature alternating between positions inside the container and positions outside the container, the feet being further defined by respective second lines, said respective second lines intersecting the respective first lines at respective lowest points of the respective first lines, with each respective second line comprising an arc segment lying in a common plane at a constant radius from said axis on each side of and contiguous to its respective first line, the second lines defining the standing ring of the container, and the second lines defining each of the feet being joined together end to end by a vertically curving segment, and each of the feet being further defined by a series of arc segments parallel to the second line, the series of arc segments diminishing in length from said second line toward said axis to a point between the centers of curvature of a third and a fourth of the curves on each first line.

15. The plastic container of claim 14 wherein each said first line is connected by a line segment joining the smallest radius curve of the series to the tubular body portion at a point opposite said first end on the largest radius curve of the series.

16. The plastic container of claim 15 wherein the minimum radius of curvature of any of the series of curves along each first line is greater than one-fifth of the radius of the tubular body portion.

17. The plastic container of claim 15 wherein the maximum radius of curvature of any of the series of curves along each first line is less than the radius of the tubular body portion and the minimum radius of curvature of any of the series of curves along each first line is greater than one-fifth of the radius of the tubular body portion.

18. The plastic container of claim 15 wherein said line segment joining the smallest radius curve of the series to the tubular body portion curves upward toward the tubular body portion and has a radius greater than the diameter of the tubular body portion.

19. A plastic container comprising a tubular body portion generally symmetric about a vertical axis, and a base portion unitary with the body portion having a plurality of feet for supporting the container upright on a horizontal surface, the feet in the base portion being defined in cross-section by a lower portion of the respective first lines, each respective first line consisting essentially of a continuous series of five curves of serially diminishing radius, each respective first line extending from a first point on the body portion through the axis to a portion of the respective foot, with said foot portion touching the horizontal surface, the series of curves having centers of curvature alternating between positions inside the container and positions outside the container, the minimum radius of curvature of any of the series of curves along each first line being greater than one-fifth of the radius of the tubular body portion.

* * * * *